US010465923B2

(12) United States Patent
Ruhlander

(10) Patent No.: US 10,465,923 B2
(45) Date of Patent: Nov. 5, 2019

(54) SUPPORT SYSTEM AND METHODS FOR HVAC SYSTEMS

(71) Applicant: Lennox Industries Inc., Richardson, TX (US)

(72) Inventor: Gregory Phillip Ruhlander, Little Elm, TX (US)

(73) Assignee: Lennox Industries Inc., Richardson, TX (US)

( * ) Notice: Subject to any disclaimer, the term of this patent is extended or adjusted under 35 U.S.C. 154(b) by 149 days.

(21) Appl. No.: 15/854,516

(22) Filed: Dec. 26, 2017

(65) Prior Publication Data

US 2019/0195515 A1 Jun. 27, 2019

(51) Int. Cl.

| | |
|---|---|
| ***F24F 1/10*** | (2011.01) |
| ***F24F 1/60*** | (2011.01) |
| ***F24F 13/32*** | (2006.01) |

(52) U.S. Cl.

CPC ..... *F24F 1/10* (2013.01); *F24F 1/60* (2013.01); *F24F 13/32* (2013.01)

(58) Field of Classification Search

CPC ..... F24F 1/10; F24F 1/60

See application file for complete search history.

(56) References Cited

U.S. PATENT DOCUMENTS

| | | | | |
|---|---|---|---|---|
| 6,095,482 | A * | 8/2000 | LaGrotta | H02B 1/50 108/51.11 |
| 8,225,581 | B2 * | 7/2012 | Strickland | E04C 3/07 52/481.1 |
| 10,180,266 | B2 * | 1/2019 | Joseph | F24F 13/32 |
| 2014/0048678 | A1 * | 2/2014 | Chen | F16M 7/00 248/678 |

* cited by examiner

*Primary Examiner* — Filip Zec

(74) *Attorney, Agent, or Firm* — Hubbard Johnston, PLLC

(57) ABSTRACT

In one instance a support unit for supporting a portion of a heating, ventilation, and air conditioning system is provided that includes a base rail frame that on two sides has at least a first pocket and second pocket for receiving the ends of a compressor beam. The compressor beam has angled faces on both ends that interface with angled faces in the pockets. In this way, when assembled and loaded, the compressor beam will fit in the pockets and remain in place. Others systems and methods are presented.

21 Claims, 8 Drawing Sheets

SUPPORT SYSTEM AND METHODS FOR HVAC SYSTEMS

TECHNICAL FIELD

This disclosure is directed, in general, to heating ventilating and cooling (HVAC) systems, and more specifically, to support systems and methods for HVAC systems, and more specifically still, but without limitation, to support units and related methods.

BACKGROUND

In packaged, roof top, and other heating ventilating and cooling (HVAC) systems supporting the structure is very important in the field and during transportation. Often a portion of the system is supported on planar member and a structure is assembled to go under one or more components that involves significant amounts of box steel and fasteners. Some of the components, like a compressor on certain units, weigh more than 120 pounds. The box steel arrangements to assist with support take considerable material and labor.

SUMMARY

According to an illustrative embodiment, a support unit for supporting a portion of a heating, ventilation, and air conditioning system includes a base rail frame having a top surface and having two parallel lateral sides, a first longitudinal side parallel to a second longitudinal side. The parallel lateral sides and first longitudinal side and second longitudinal side together form a closed end frame having an interior portion. The support unit further includes at least a first pocket formed on the first longitudinal side of the base rail frame having a first upward angled rail face directed toward the interior portion and at least a second pocket formed on the second longitudinal side of the base rail frame having a second upward angled rail face directed toward the interior portion. The second pocket is formed directly across the interior portion from the first pocket.

The support unit further includes a first compressor beam having a first end and a second end, a top surface, a first longitudinal side, and a second longitudinal side and further including a first downward angled face formed on the first end of the first compressor beam and configured to substantially mate with the first upward angled rail face of the first pocket. The first compressor beam also includes a second downward angled face formed on the second end of the first compressor beam and configured to substantially mate with the second upward angled rail face of the second pocket. In an assembled position, the top surface of the first compressor beam is substantially flush with the top surface of the base rail frame. The support unit also includes a base pan disposed over the top surface of the base rail frame.

According to another illustrative embodiment, a heating, ventilating, and cooling (HVAC) system includes a compressor; a condenser fluidly coupled to the condenser for receiving a refrigerant therefrom; an expansion device fluidly coupled to the condenser for receiving a refrigerant therefrom; and an evaporator fluidly coupled to the expansion device for receiving a refrigerant therefrom. The system also includes a base rail frame having a top surface and having two parallel lateral sides, a first longitudinal side parallel to a second longitudinal side. The parallel lateral sides and first longitudinal side and second longitudinal side together form a closed end frame having an interior portion.

The system further includes at least a first pocket formed on the first longitudinal side of the base rail frame having a first upward angled rail face directed toward the interior portion and at least a second pocket formed on the second longitudinal side of the base rail frame having a second upward angled rail face directed toward the interior portion. The second pocket is typically formed across the interior portion from the first pocket. The system has at least a first compressor beam having a first end and a second end, a top surface, a first longitudinal side, and a second longitudinal side. A first downward angled face is formed on the first end of the first compressor beam and configured to substantially mate with the first upward angled rail face of the first pocket. A second downward angled face is formed second end of the first compressor beam and configured to substantially mate with the second upward angled rail face of the second pocket.

In an assembled position, the top surface of the first compressor beam may be substantially flush with the top surface of the base rail frame. The system also includes a base pan formed to substantially cover the interior portion of the base rail frame and, in an assembled position, supported in part along a peripheral edge by the base rail frame and a plurality of first fasteners that in the assembled position extend through the base pan and are coupled to the first compressor beam. The compressor is disposed on the base pan and is at least partially supported by the first compressor beam.

According to still another illustrative non-limiting embodiment, a method of manufacturing a support unit for supporting a portion of a heating, ventilation, and air conditioning system includes forming a base rail frame having a top surface and having two parallel lateral sides, a first longitudinal side parallel to a second longitudinal side. The parallel lateral sides and first longitudinal side and second longitudinal side together form a closed end frame having an interior portion. The method further includes forming at least a first pocket on the first longitudinal side of the base rail frame having a first upward angled rail face directed toward the interior portion; forming at least a second pocket on the second longitudinal side of the base rail frame having a second upward angled rail face directed toward the interior portion. The second pocket is formed across the interior portion from the first pocket. The method also involves providing a first compressor beam having a first end and a second end, a top surface, a first longitudinal side, and a second longitudinal side.

The method also involves forming a first downward angled face on the first end of the first compressor beam that is configured to substantially mate with the first upward angled rail face of the first pocket; forming a second downward angled face on the second end of the first compressor beam that is configured to substantially mate with the second upward angled rail face of the second pocket; and disposing the first compressor beam on to the base rail frame such that the first pocket engages the first downward angled face of the first end of the first compressor beam and such that the second pocket engages the second downward angled face of the second end of the first compressor beam.

Other embodiments are included below and contemplated herein.

DESCRIPTION OF THE DRAWINGS

Illustrative embodiments of the present invention are described in detail below with reference to the attached drawing figures, which are incorporated by reference herein and wherein.

DETAILED DESCRIPTION

Figure 1:
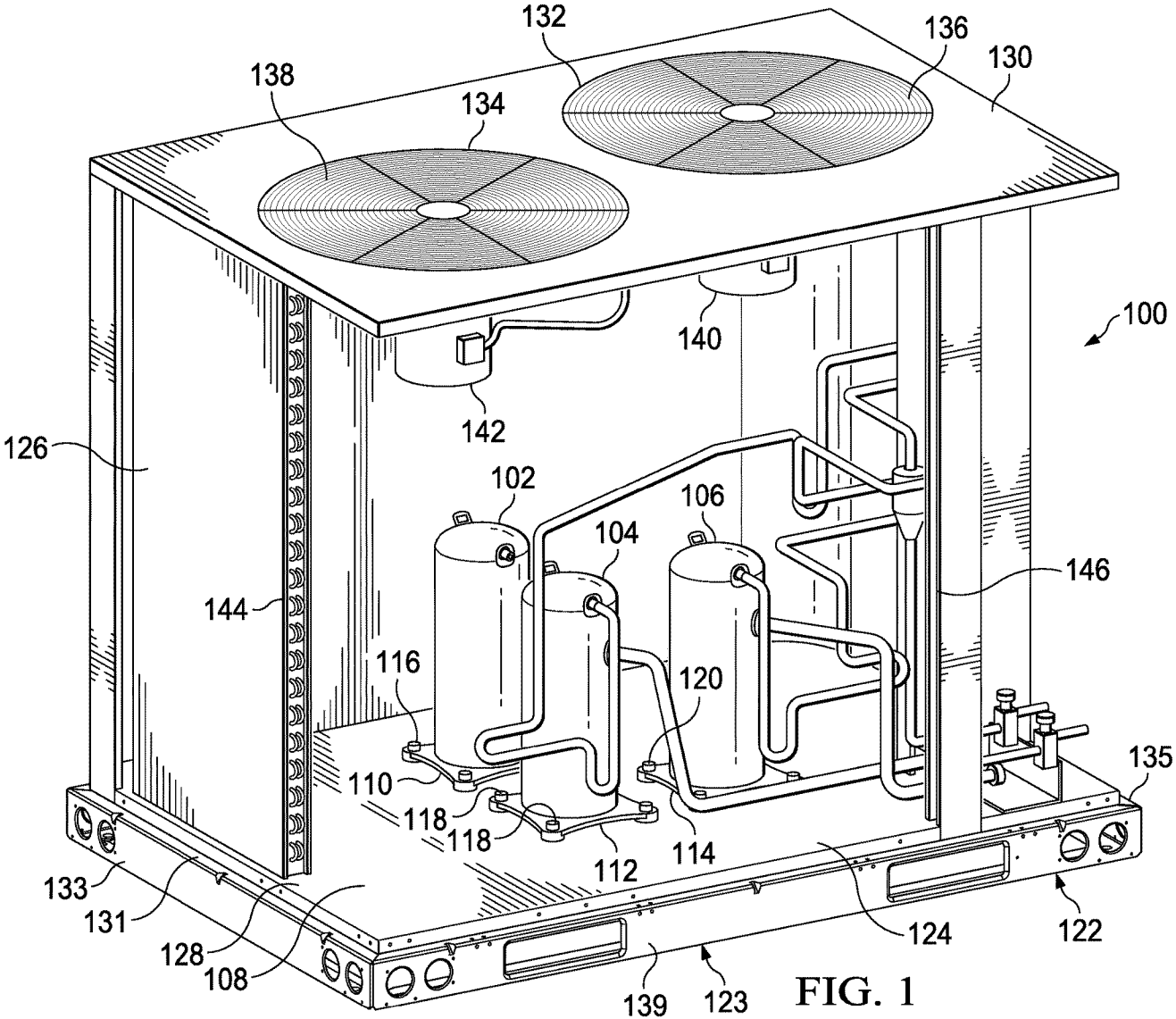
FIG. 1 is a schematic, perspective view of an illustrative embodiment of a portion of a heating ventilating and cooling (HVAC) system.

Heating, ventilation, and cooling (HVAC) systems come in many shapes and sizes. All the various HVAC systems must be supported in transport and when in an installed position in the field. Moreover, during transportation, the support structure must be able to handle enhanced loading, e.g., 3 Gs, as well as lateral accelerations. The methods and systems described herein for supporting aspects of HVAC systems may be included with a wide range of HVAC systems and provide such support. Referring to the drawings, and initially to FIG. 1, one illustrative, non-limiting embodiment of a portion of an HVAC system 100 that includes such a structure is presented.

The portion of the HVAC system 100 shown in FIG. 1 includes three compressors 102, 104, and 106 mounted on a base pan 108. The base pan 108 provides a support surface and may be a substantially planar member or may take other shapes. Each compressor 102, 104, 106 is shown having a base plate 110, 112, 114 on top of the base pan 108. Each base plate 110, 112, 114 is secured with fasteners 116, 118, and 120, respectively, to the base pan 108 or to a compressor beam (see, e.g., 144 in FIG. 3). In this example, fasteners 116 and 118 are coupled to the compressor beam (see 147 in FIG. 3) that runs underneath compressors 102 and 104, and fasteners 120 are coupled to another compressor beam that runs under compressor 106. The base pan 108 is supported at least in part by a top of the base rail frame 122, which is part of a support unit 123, or support rail unit. The fasteners 116, 118, 120 used to couple the compressor to the compressor beam 147 sandwich the base pan 108 in between. In one illustrative embodiment, the base rail frame 122 is made from a single member that is bent to form three corners and then coupled at a fourth corner to make a closed rectangular frame. One skilled in the art, will understand that other techniques may be used for making the base rail frame 122. The base rail frame 122 may be made from a light weight steel, aluminum alloys, plastic, or other suitable materials.

The compressors 102, 104, and 106 are shown on the base pan 108 and in an interior portion 124 of the base rail frame 122. While three compressors are shown, one skilled in the art will understand that one or two or another number of compressors might be used. The compressors 102, 104, and 106 are associated with a condenser 126 on an outboard portion 128 of the base pan 108. A top member 130 is formed with apertures 132 and 134 covered by grills 136 and 138 respectively. Condenser fans 140 and 142 are associated with the apertures 132 and 134. A sheet metal enclosure member (not explicitly shown) would typically extend from edge 144 to edge 146 but has been removed so that the interior portion 124 is visible.

Figure 2:
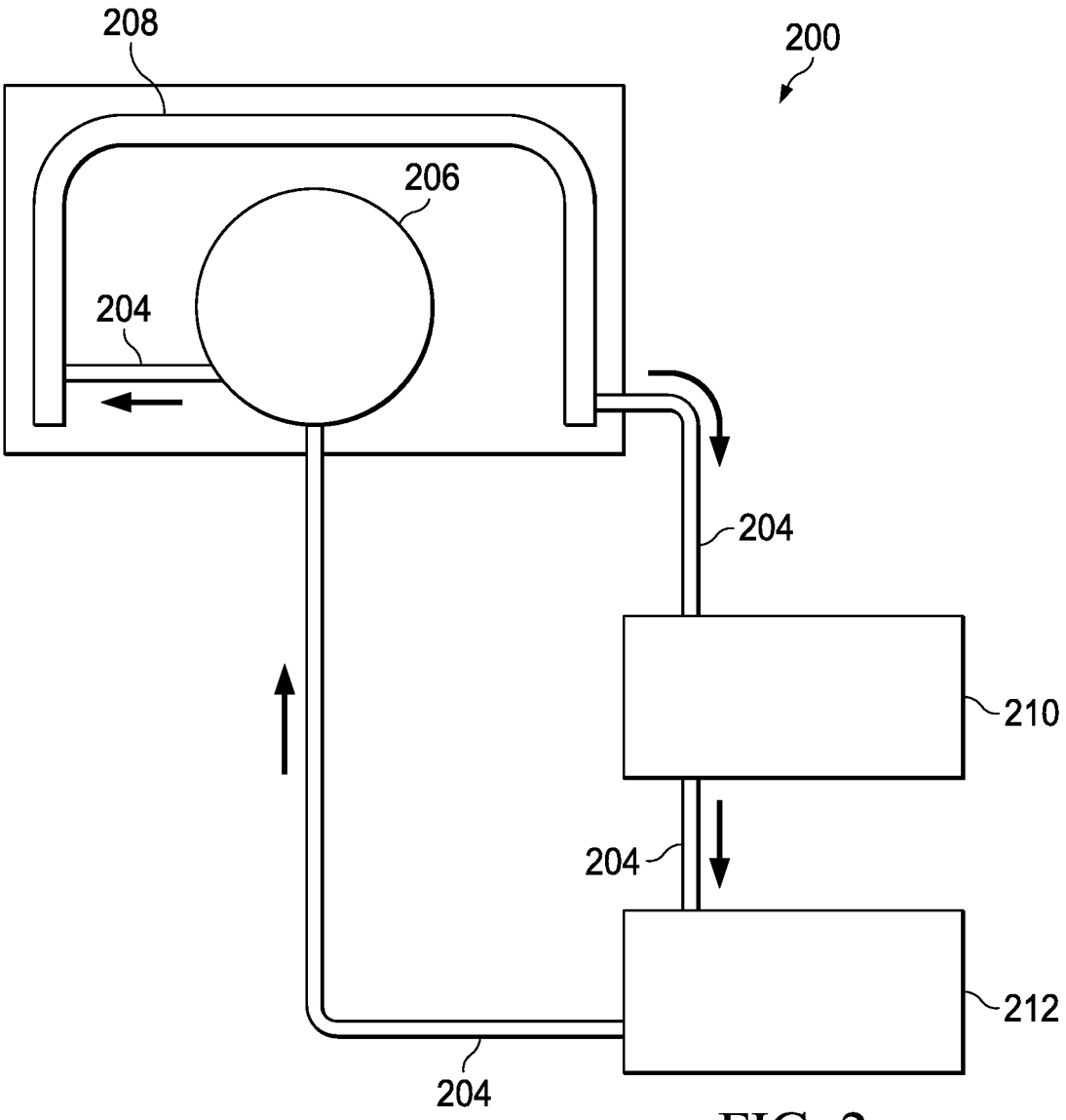
FIG. 2 is a schematic diagram of an illustrative, non-limiting embodiment of a heating ventilating and cooling (HVAC) system that may be used with a support unit.

The compressors 102, 104, and 106 and the condenser 126 form part of a refrigeration or cooling unit. In this regard, referring primarily to FIG. 2, an illustrative, non-limiting example of a cooling unit 200 of an HVAC system is presented. The cooling unit 200 includes a closed-conduit circuit 204 that circulates a refrigerant in various phases and fluidly couples the various elements described in the cooling unit. The refrigerant is disposed within the closed-conduit circuit 204. The cooling system 200 includes a compressor 206 (see also 102, 104, and 106 in FIG. 1) fluidly coupled to the closed-conduit circuit 204 for compressing the refrigerant therein. A condenser 208 (see also 126 in FIG. 1) is fluidly coupled to the closed-conduit circuit 204 downstream of the compressor 208. The condenser 208 may include one or multiple condensers of various types for cooling the refrigerant. The condenser 208 may be associated with one or more fans (see 140 and 142 of FIG. 1). An expansion device 210 is fluidly-coupled to the closed-conduit circuit 204 downstream of the condenser 208 for decreasing a pressure of the refrigerant. The refrigerant is then delivered to an evaporator unit 212. From there, the refrigerant is returned to the compressor 206 and the cycle continues again. The evaporator unit 212 cools air that is then delivered to a desired location by other aspects of the HVAC system. Those skilled in the art will appreciate many variations on the cooling unit that may be utilized.

Figure 3:
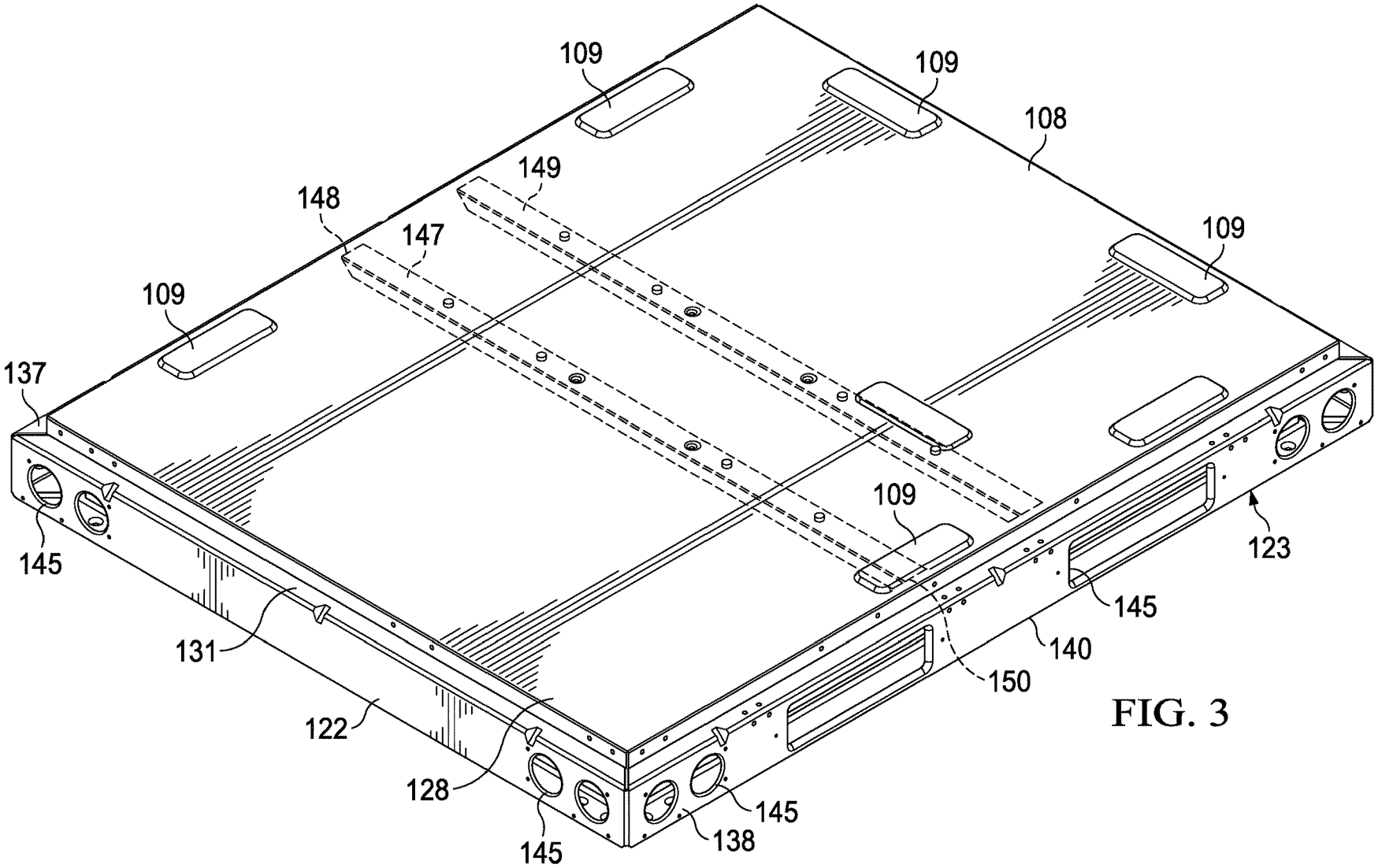
FIG. 3 is a schematic, perspective view of an illustrative embodiment of a support unit.
Figure 4:
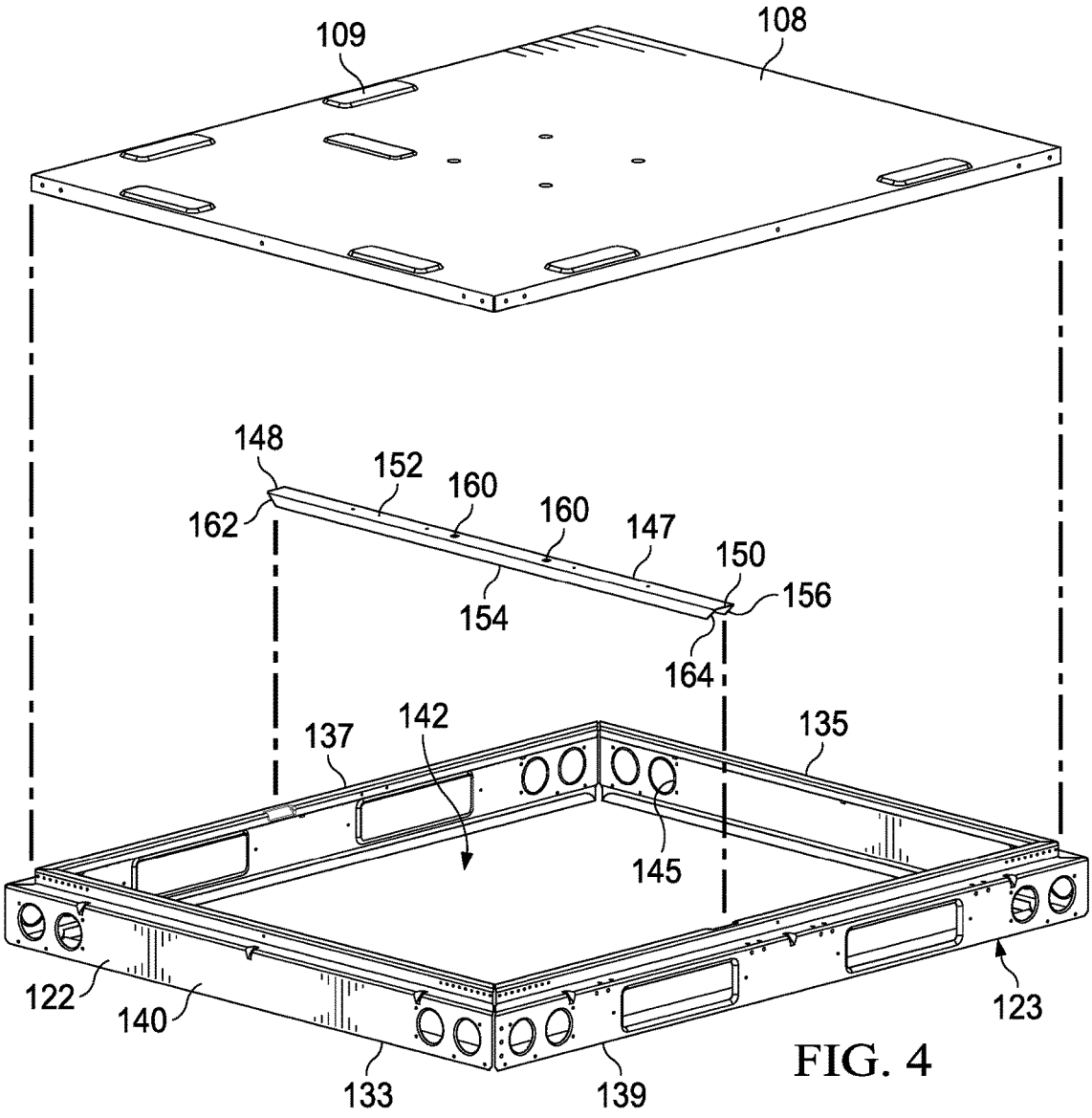
FIG. 4 is a schematic, exploded, perspective view of the support unit of FIG. 3.

Referring now primarily to FIGS. 3-8, and initially to FIG. 3, the illustrative, non-limiting embodiment of the support unit 123 will be described in more detail. The base rail frame 122 has a top surface 131 and has first lateral side 133 and a second lateral side 135 that are parallel to one another. The base rail frame 122 also has a first longitudinal side 137 parallel to a second longitudinal side 139. The parallel lateral sides 133 and 135 and first longitudinal side 137 and second longitudinal side 139 together forming a closed end frame or base rail frame 122 having the interior portion 124. The base rail frame 122 may be formed with various cutouts 145 for providing connection points for lifting cranes (hooks and straps), forklift slots, or small holes for reinforcing plates or protection plates.

The support unit 123 includes a first compressor beam 147 and a second compressor beam 149. The second compressor beam 149 is only shown in FIG. 3, but is analogous to the first compressor beam 147 in its application. Both compressor beams 147 and 149 are analogous and for efficiency only the first compressor beam 147 is described herein in detail but one should understand the second beam 149 or any other included beams would be analogous. Any number beams might be included.

Figure 5:
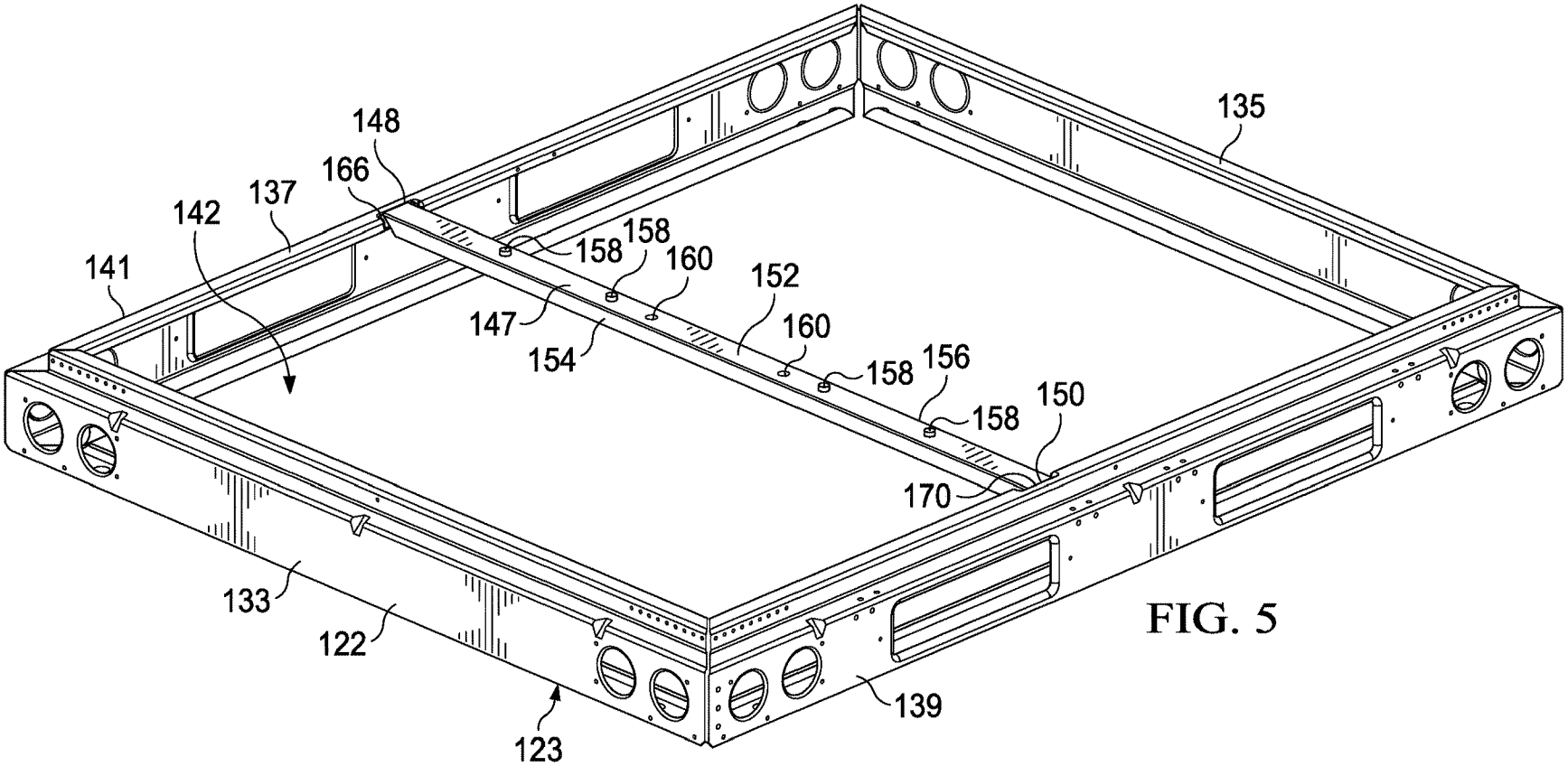
FIG. 5 is a schematic, perspective view of an illustrative embodiment of a support unit without a base panel applied.

As shown clearly in FIG. 5, the first compressor beam 147 has a first end 148 and a second end 150, a top surface 152, a first longitudinal side 154 (or skirt), and a second longitudinal side 156 (opposite the first longitudinal side 154). While the first compressor beam 147 (and other beams referenced herein) may be U-shaped in cross section as described other shapes (e.g., square, or W-shaped) may be used as well as a person of ordinary skill in the art would understand. The first longitudinal side 154 and second longitudinal side 156 may be extended further down (for the orientation shown in FIG. 5) to provide additional strength. As that is done, the centroid of the beam goes lower and the strength goes up. The first compressor beam 147 may be formed of the same materials as the base rail frame 122.

Figure 8:
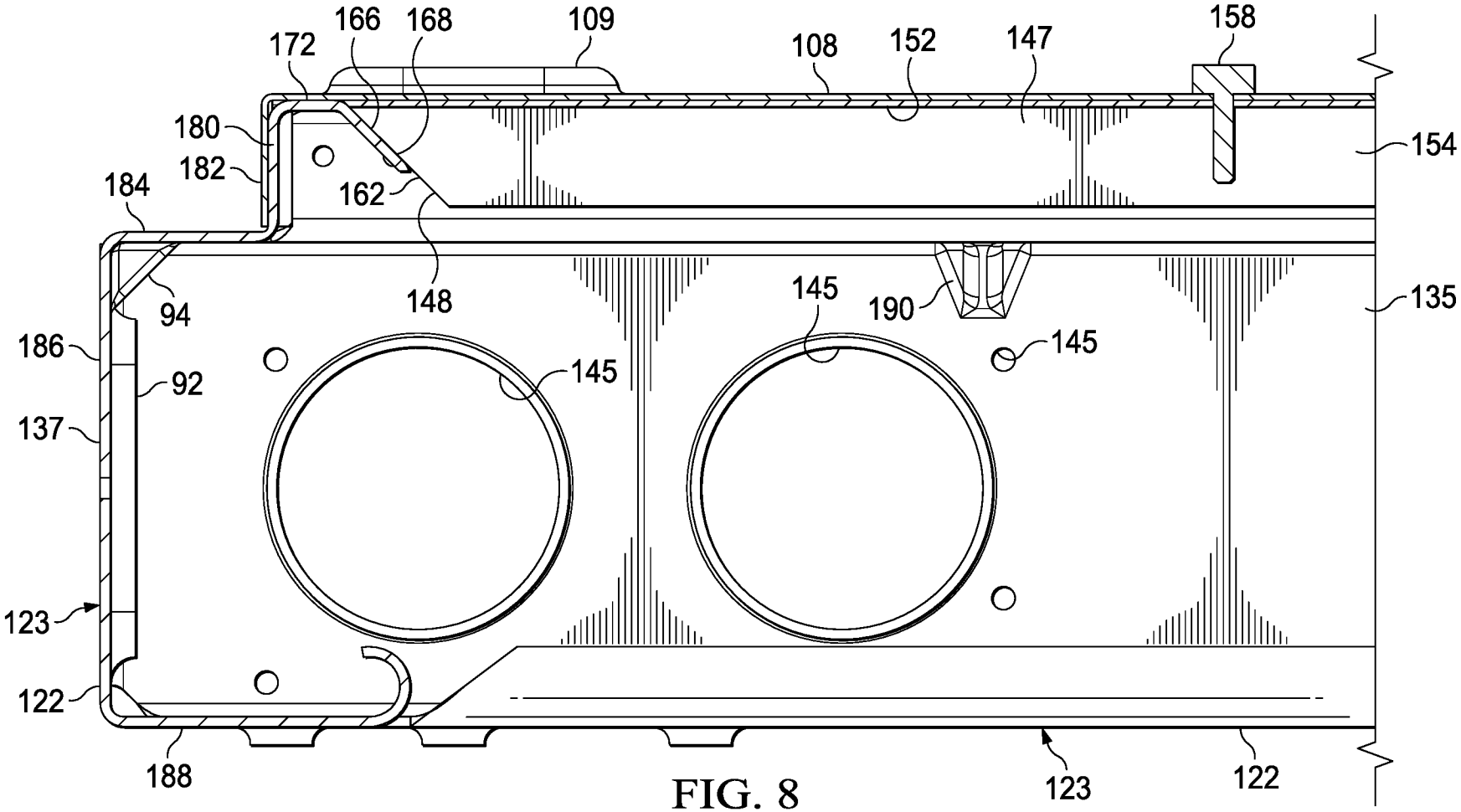
FIG. 8 is a schematic, cross-sectional view of an illustrative embodiment of a portion of a support unit of FIG. 5 taken just left of the first end of the first cross beam in FIG. 5 and looking to the right down the first longitudinal side.

The base pan 108 may be coupled to the first compressor beam 147 by a plurality of fasteners 158 shown clearly in FIGS. 5 and 8. A plurality of apertures 160 may be formed for receiving fasteners, e.g., fasteners 116 and 118, associated with a supported compressor, e.g., 102, 104. The apertures 160 may be formed with any pattern or position to coordinate with the supported compressor or other equipment over the corresponding compressor beam. As described in further detail further below, the first end 148 of the first compressor beam 147 may be formed with a first downward angled face 162 and a second downward angled face 164 may be formed on the second end 150.

Figure 6:
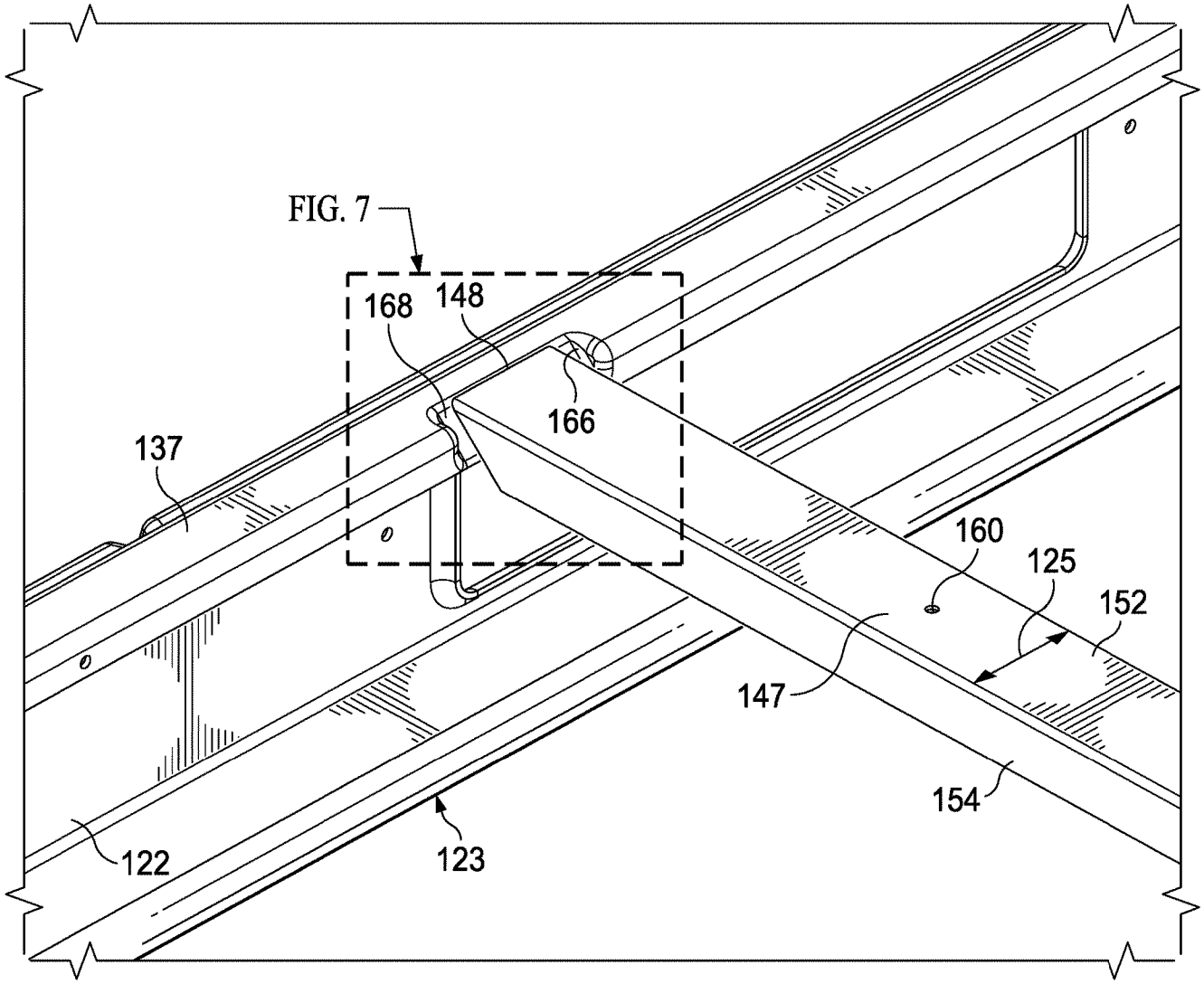
FIG. 6 is a schematic, perspective view of an illustrative embodiment of a portion of a support unit.
Figure 7:
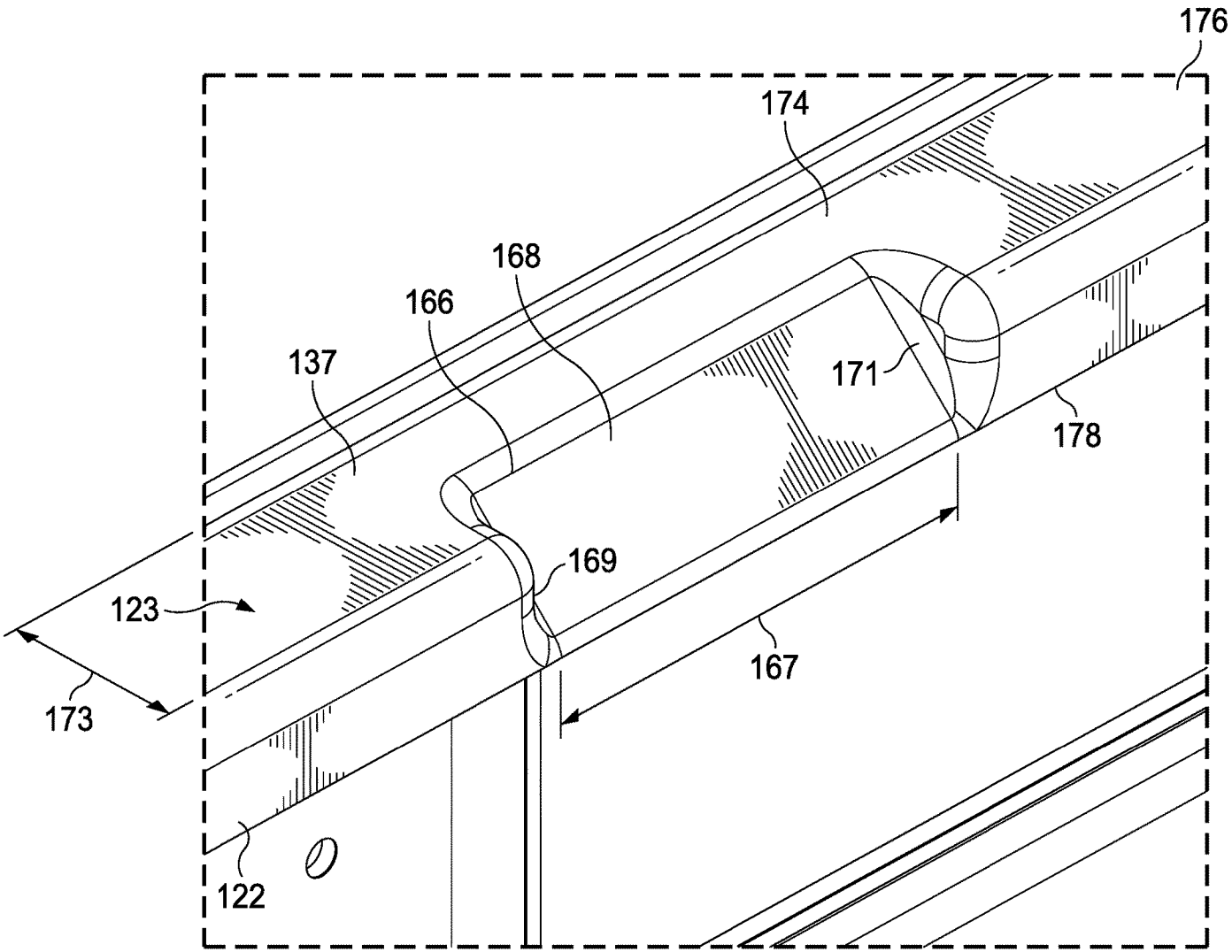
FIG. 7 is a detail view of a portion of the support unit of FIG. 6.

Referring now primarily to FIGS. 5-7, at least a first pocket 166, or contact pocket, is formed on the first longitudinal side 137 of the base rail frame 122. The first pocket 166 has a first upward angled rail face 168 directed toward the interior portion 124 and a first lateral wall 169 and a second lateral wall 171. The first pocket 142 may be formed with rounded corners and transitions areas. The first upward angled rail face 168 has a width 167 (FIG. 7) at least as wide (parallel to first longitudinal side) as the corresponding width (small dimension) of the first compressor beam 147 and has a length (orthogonal to first longitudinal side 137) that is approximately the same as a cross dimension 173 (FIG. 7) of the first longitudinal side 137, but other dimensions are, of course, possible. In one illustrative, non-limiting embodiment, the width 167 may be such that the pocket forms an interference fit with the width 175 of the compressor beam 147, and in other embodiments, the width 167 may provide some clearance or gap, e.g., a gap having a dimension up to 5% of the width 167 and in some embodiments+/−0.030 inches. The a first upward angled rail face 168 is coordinated to substantially align or mate with the first downward angled face 162 on the first end 148 of the compressor beam 144. In one illustrative embodiment, the angle ($\alpha$) of the upward angled rail face 168 is 45 degrees from horizontal (i.e., orthogonal to gravitation field), but other angles are possible. In other embodiments, the angle ($\alpha$) of the angled rail face 168 is between 5 and 95 degrees.

In an analogous fashion (and therefore not shown in detail), at least a second pocket 170 is formed on the second longitudinal side 139 of the base rail frame 122. Again, the second pocket 170 is formed with a first upward angled rail face directed toward the interior portion 124. The second pocket 170 is formed across (angled or directly across) the interior portion 124 from the first pocket 166. It will be appreciated that a longitudinal length of the first compressor beam 147 is sized so that the first downward angled face 162 of the compressor beam 147 mates with the first pocket 166 and the second downward angled face 164 mates with the second pocket 170. Moreover, the longitudinal length of the first compressor beam 147 may be sized and configured so that the top surface 152 is substantially flush with the top surface 130 of the base rail frame 122 when in the assembled position. In some embodiments, the longitudinal length of the first compressor beam 147 may be sized to form an interference fit with the pockets 166 and 170.

The first downward angled face 162 formed at the first end 148 of the first compressor beam 147 is configured to substantially mate with the first upward angled rail face 168 of the first pocket 166. An angle ($\theta$) of the first downward angled face 162 relative to horizontal (orthogonal to gravitational field) may be selected to be identical with or substantially the same as the angle ($\alpha$) of the first upward angled rail face 168 on the first longitudinal side 137 of the base rail frame 122. In this previous sentence, "substantially same" means within two degrees. The angle $\theta$ may vary between 5 and 95 degrees, but often is selected to be 45 degrees. The second downward angled face 164 on the second end 150 of the first compressor beam 147 is formed in analogous fashion to that of the first downward angled face 162.

It should be noted that the compressor beams, e.g., compressor beam 147, may thus be installed in the support unit 123 without requiring any fasteners. The weight of the load supported by the compressor beam 147 further drives the angled faces 162, 164 into or towards the mating angled rail faces, e.g., 168, of the first and second pockets 166, 170. That is, in the assembled position and loaded state, no fasteners are required to hold the first downward angled face 162 formed at the first end 148 of the first compressor beam 147 to the first upward angled rail face 168 of the first pocket 166 and to hold the second downward angled face 164 formed second end 150 of the first compressor beam 144 to the second upward angled rail face of the second pocket 170. Among other things, this may make for faster assembly, fewer parts, and greater stability than previously known systems. Still, in some embodiments, a fastener could be added.

It should also be understood that while only two pockets 166, 170 are shown and described, numerous additional pockets may be formed on the longitudinal sides 137, 139. For example, without limitation, a third pocket and a fourth pocket may be included. Likewise, as previously referenced, while on only compressor beam 147 is described, numerous compressor beams might be included. In one illustrative non-limiting embodiment, the support unit 123 includes at least a third pocket formed on the first longitudinal side 137 having a first upward angled rail face (analogous to first upward angled rail face 168) directed toward the interior portion 124 and spaced from the first pocket 166 formed on the first longitudinal side; at least a fourth pocket formed on the second longitudinal side 139 having a second upward angled rail face directed toward the interior portion 124, wherein the second pocket is formed across the interior portion 124 from the third pocket; a second compressor beam having a first end and a second end, a top surface, a first longitudinal side, and a second longitudinal side; a first downward angled face formed on the first end of the second compressor beam and configured to mate with the first upward angled rail face of the third pocket; a second downward angled face formed second end of the second compressor beam and configured to mate with the second upward angled rail face of the fourth pocket; and wherein, in an assembled position, the top surface of the second compressor beam is substantially flush with the top surface of the base rail frame.

As previously noted, the base pan 108 may be coupled to one or more compressor beams, e.g., compressor beam 147. The base pan 108 may include raised pads 109 formed on a top surface of the base pan 108. The raised pads 109 provide support for parts, such as the coil. The coil and any other parts sit on these raised pads 109 to keep them elevated and so water will run of the pan and not collect on the parts. The base pan 108 is formed to substantially cover the interior portion 124 of the base rail frame 122 and, in an assembled position, be supported at least in part along a peripheral edge 172 (FIG. 8) by the base rail frame 122. The plurality of fasteners 158, in the assembled position, extend through the base pan 108 and are coupled to the first compressor beam 147.

Referring primarily to FIG. 7, in one illustrative, non-limiting embodiment, the angled face of the pocket 166 extends at about 45 degrees to horizontal. In this embodiment, the pocket 166 extends from a midline of top planar member 174 of the top portion 176 of the longitudinal side 137 to a lower edge 178 of the top portion 176. Other angles and proportions may be used.

Referring now primarily to FIG. 8, a cross section is taken that would be just to the left of the compressor beam in FIG. 5 looking down the first longitudinal side 137 and with a base panel 108 added. In this view the second lateral side 135 is visible at the end and running in and out of the page is the first longitudinal side 137. In this view it can be seen that the rail frame member 122 comprising the first longitudinal side 137 includes the first upward angled rail face 168 that is coupled to a peripheral edge member 172 that is substantially horizontal in this embodiment. The peripheral edge member 172 is coupled to a first vertical segment 180. The base pan 108 may have a vertical end portion 182 that is abuts the vertical segment 180 of the longitudinal side 137. The vertical segment 180 is coupled to a horizontal shelf portion 184. The horizontal shelf portion 184 is coupled to a second vertical portion 186. The second vertical portion 186 may be coupled to a foot portion 188, or base portion. The foot portion 188 may include a curled skid 196. Notches 190 and 194 are bent in the material to strengthen the edge of the frame. Item 192 is a side view of the material that gets rolled back in the forklift openings; this helps to provide a smooth contact surface and to strengthen the edge of the opening in the base rail.

As shown in FIG. 8, the upward angled rail face 168 may be shorter than the first downward angled face 162 of the first end 148 of the first compressor beam 147. In one illustrative embodiment, the length of the first upward angled rail face 168 as shown in FIG. 8 is between 40% and 100% of the corresponding dimension of the first downward angled face 162. The two faces may be the same size in other embodiments.

Referring to the Figures, an illustrative, non-limiting embodiment of a method of manufacturing a support unit for supporting a portion of a heating, ventilation, and air cooling system is presented. The method includes forming a base rail frame having a top surface and having two parallel lateral sides, and a first longitudinal side parallel to a second longitudinal side. The parallel lateral sides and first longitudinal side and second longitudinal side together form a closed end frame having an interior portion. The method further includes forming at least a first pocket on the first longitudinal side of the base rail frame having a first upward angled rail face directed toward the interior portion; forming at least a second pocket on the second longitudinal side of the base rail frame having a second upward angled rail face directed toward the interior portion. The second pocket is formed across (angled or directly across) the interior portion from the first pocket. To form a pocket, the rail frame is formed and then secondary tooling may be used to press form the pockets.

The methods also involve providing a first compressor beam having a first end and a second end, a top surface, a first longitudinal side, and a second longitudinal side. The method further comprises forming a first downward angled face on the first end of the first compressor beam that is configured to substantially mate with the first upward angled rail face of the first pocket; forming a second downward angled face on the second end of the first compressor beam that is configured to substantially mate with the second upward angled rail face of the second pocket; and disposing the first compressor beam on to the base rail frame such that the first pocket engages the first upward angled face of the first end of the first compressor beam and such that the second pocket engages the second downward angled face of the second end of the first compressor beam.

In one illustrative embodiment, the method of manufacturing of the previous paragraph further includes disposing a base pan onto the base rail frame covering the interior portion and wherein the base rail frame is substantially flush with the top of the first compressor beam; and fastening the base pan to the first compressor beam with a plurality of fasteners.

In one illustrative embodiment, a support unit goes under a portion of an HVAC system to support one or more aspects of such a system. The supported equipment rests on a frame having a top cover, or base pan. The nature of the top cover suggests that a support beam, or crossbeam, is necessary to go under top cover. In one illustrative embodiment, the crossbeam is made with angled faces formed on each of longitudinal end of the crossbeam. Then there are matching or substantially matching angled sections formed at pockets on two opposite sides of the frame. To put the crossbeam in position, it is placed so that the two angled faces of the crossbeam go into the pockets against the two angled faces in the pockets. Once there, the weight of the beam forces the two faces together and even more so once it is loaded. The crossbeam is flush with the top edge or top perimeter or lip of the frame. The cover, or base pan, may be placed over the crossbeam and the rail frame. Equipment to be supported may be applied on the base pan and fasteners extended from that equipment through the base pan or cover and into the crossbeam. It should be understood that the support unit may include any number of crossbeams; that is, one or a plurality of crossbeams as required for the equipment. Each item of equipment supported may be coupled to one crossbeam or multiple crossbeams. This arrangement adds internal support and stiffening of the base pan. It should be noted that the arrangement is self positioning when assembled and stabilizes once loaded.

By providing a surface-to-surface contact at the ends of the crossbeam, or compressor beam, the structure allows for flexure and supports the weight of the equipment. The crossbeams help to support and damp any flexure or vibrations from system operations or shipping impacts. In one alternative embodiment, a dampener member may be disposed between the downward angled face on each end of the crossbeam and the matching upward angled rail face in a corresponding pocket. The dampening member may be an elastomeric material, such as a centimeter thick rubber member or natural rubber such as EPDM, NBR, or Silicon. The dampening member could also be a thermoplastic elastomer such as TPE's, or any ductile plastic such as an impact grade ABS plastic. The dampening member may be secured to either of the matching angled faces before installation with glue or other means. The dampening member would help to absorb energy to dampen vibrations.

While the examples herein are given with respect to a compressor and the term "compressor beam" is used, it should be understood that other package units might be supported in the same way and are within the scope of this disclosure.

In the detailed description herein of the preferred embodiments, reference is made to the accompanying drawings that form a part hereof, and in which is shown, by way of illustration, specific embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The detailed description is, therefore, not to be taken in a limiting sense, and the scope of the present invention is defined only by the claims. Unless otherwise indicated, as used throughout this document, "or" does not require mutual exclusivity.

Although the present invention and its advantages have been disclosed in the context of certain illustrative, non-limiting embodiments, it should be understood that various changes, substitutions, permutations, and alterations can be made without departing from the scope of the invention as defined by the claims. It will be appreciated that any feature that is described in a connection to any one embodiment may also be applicable to any other embodiment.

What is claimed:

1. A support unit for supporting a portion of a heating, ventilation, and cooling system, the support unit comprising:

a base rail frame having a top surface and having two parallel lateral sides, a first longitudinal side parallel to a second longitudinal side, the parallel lateral sides and the first longitudinal side and the second longitudinal side together forming a closed end frame having an interior portion;

at least a first pocket formed on the first longitudinal side of the base rail frame having a first upwardly angled rail face directed toward the interior portion;

at least a second pocket formed on the second longitudinal side of the base rail frame having a second upwardly angled rail face directed toward the interior portion, wherein the second pocket is formed across the interior portion from the first pocket;

a first compressor beam having a first end and a second end, a top surface, a first longitudinal side, and a second longitudinal side;

a first downwardly angled face formed on the first end of the first compressor beam and configured to substantially mate with the first upwardly angled rail face of the first pocket;

a second downwardly angled face formed on the second end of the first compressor beam and configured to substantially mate with the second upwardly angled rail face of the second pocket;

wherein, in an assembled position, the top surface of the first compressor beam is substantially flush with the top surface of the base rail frame; and a base pan disposed over the top surface of the base rail frame.

2. The support unit of claim 1, further comprising:

the base pan formed to substantially cover the interior portion of the base rail frame and, in an assembled position, supported at least in part along a peripheral edge of the base rail frame;

a plurality of first fasteners that in the assembled position extend through the base pan and are coupled to the first compressor beam.

3. The support unit of claim 1, further comprising:

at least a third pocket formed on the first longitudinal side having a first upwardly angled rail face directed toward the interior portion and spaced from the first pocket formed on the first longitudinal side;

at least a fourth pocket formed on the second longitudinal side having a first upwardly angled rail face directed toward the interior portion, wherein the second pocket is formed across the interior portion from the third pocket;

a second compressor beam having a first end and a second end, a top surface, a first longitudinal side, and a second longitudinal side;

a first downwardly angled face formed on the first end of the second compressor beam and configured to mate with the first upwardly angled rail face of the third pocket;

a second downwardly angled face formed second end of the second compressor beam and configured to mate with the second upwardly angled rail face of the fourth pocket; and wherein, in an assembled position, the top surface of the second compressor beam is substantially flush with the top surface of the base rail frame.

4. The support unit of claim 1, wherein the first compressor beam in cross section is substantially U-shaped, square, or W-shaped.

5. The support unit of claim 1, wherein the first upwardly angled rail face of the of the first pocket of the first longitudinal side has an angle between 5 and 95 degrees from horizontal, which is orthogonal to a gravity field.

6. The support unit of claim 1, wherein the first upwardly angled rail face of the of the first pocket of the first longitudinal side has an angle between 40 and 50 degrees from horizontal, where the horizontal is orthogonal to the gravity field.

7. The support unit of claim 1, wherein the first compressor beam is sized and configured to form an interference fit between the first pocket formed on the first longitudinal side and the second pocket formed on the second longitudinal side.

8. The support unit of claim 1, wherein in the assembled position and loaded state no fasteners are required to hold the first downward angled face formed first end of the first compressor beam to the first upward angled rail face of the first pocket and to hold the second downward angled face formed second end of the first compressor beam to the second upward angled rail face of the second pocket.

9. The support unit of claim 1, further comprising a first dampener member disposed between the first upward angled face of the first pocket formed on the first longitudinal side of the base rail frame and the first downward angled face formed on the first end of the first compressor beam.

10. The support unit of claim 1, further comprising a first dampener member disposed between the first upward angled rail face of the first pocket formed on the first longitudinal side of the base rail frame and the first downward angled face formed first end of the first compressor beam and a second dampener member disposed between the second upward face of the second pocket formed on the first longitudinal side of the base rail frame and the second downward angled face formed on the second end of the first compressor beam.

11. An heating, ventilating, and cooling system comprising:

a compressor for compressing a refrigerant;

a condenser fluidly coupled to the compressor for receiving the refrigerant therefrom;

an expansion device fluidly coupled to the condenser for receiving the refrigerant therefrom;

an evaporator fluidly coupled to the expansion device for receiving the refrigerant therefrom;

a base rail frame having a top surface and having two parallel lateral sides, a first longitudinal side parallel to a second longitudinal side, the parallel lateral sides and first longitudinal side and second longitudinal side together forming a closed end frame having an interior portion;

at least a first pocket formed on the first longitudinal side of the base rail frame having a first upward angled rail face directed toward the interior portion;

at least a second pocket formed on the second longitudinal side of the base rail frame having a second angled rail face directed toward the interior portion, wherein the second pocket is formed across the interior portion from the first pocket;

a first compressor beam having a first end and a second end, a top surface, a first longitudinal side, and a second longitudinal side;

a first downward angled face formed first end of the first compressor beam and configured to substantially mate with the first upward angled rail face of the first pocket;

a second downward angled face formed on the second end of the first compressor beam and configured to substantially mate with the second upward angled rail face of the second pocket;

wherein, in an assembled position, the top surface of the first compressor beam is substantially flush with the top surface of the base rail frame;

a base pan formed to substantially cover the interior portion of the base rail frame and, in an assembled position, supported at least in part along a peripheral edge by the base rail frame;

a plurality of first fasteners that in the assembled position extend through the base pan and are coupled to the first compressor beam; and wherein the compressor is disposed on the base pan and is at least partially supported by the first compressor beam.

12. The heating, ventilating, and cooling system of claim 11, further comprising:

at least a third pocket formed on the first longitudinal frame having a first upward angled rail face directed toward the interior portion and spaced from the first pocket formed on the first longitudinal frame;

at least a fourth pocket formed on the second longitudinal frame having a first upward angled rail face directed toward the interior portion, wherein the second pocket is formed across the interior portion from the third pocket;

a second compressor beam having a first end and a second end, a top surface, a first longitudinal side, and a second longitudinal side;

a first downward angled face formed on the first end of the second compressor beam and configured to mate with the first upward angled rail face of the third pocket;

a second downward angled face formed second end of the second compressor beam and configured to mate with the second upward angled rail face of the fourth pocket; and wherein, in an assembled position, the top surface of the second compressor beam is substantially flush with the top surface of the base rail frame.

13. The heating, ventilating, and cooling system of claim 11, wherein the first compressor beam is U-shaped in cross section.

14. The heating, ventilating, and cooling system of claim 11, wherein the a first upward angled rail face of the of the first pocket of the first longitudinal side has an angle between 5 and 95 degrees from horizontal, which is orthogonal to a prevailing gravity field.

15. The heating, ventilating, and cooling system of claim 11, wherein the a first upward angled rail face of the of the first pocket of the first longitudinal side has an angle between 40 and 50 degrees from horizontal, which is orthogonal to a gravity field.

16. The heating, ventilating, and cooling system of claim 11, wherein the first compressor beam is sized and configured to form an interference fit with the first pocket formed on the first longitudinal side and the second pocket formed on the second longitudinal side.

17. The heating, ventilating, and cooling system of claim 11, wherein in the assembled position and loaded state, no fasteners are required to hold the first downward angled face formed at the first end of the first compressor beam to the first upward angled rail face of the first pocket and to hold the second downward angled face formed second end of the first compressor beam to the second upward angled rail face of the second pocket.

18. The heating, ventilating, and cooling system of claim 11, further comprising a first dampener member disposed between the first pocket formed on the first longitudinal side of the base rail frame and the first downward angled face formed first end of the first compressor beam.

19. The heating, ventilating, and cooling system of claim 11, further comprising a first dampener member disposed between the first pocket formed on the first longitudinal side of the base rail frame and the first downward angled face formed first end of the first compressor beam and a second dampener member disposed between the second pocket formed on the first longitudinal side of the base rail frame and the second downward angled face formed second end of the first compressor beam.

20. A method of manufacturing a support unit for supporting a portion of a heating, ventilation, and cooling system, the method comprising:

forming a base rail frame having a top surface and having two parallel lateral sides, a first longitudinal side parallel to a second longitudinal side, the parallel lateral sides and first longitudinal side and second longitudinal side together forming a closed end frame having an interior portion;

forming at least a first pocket on the first longitudinal side of the base rail frame having a first upward angled rail face directed toward the interior portion;

forming at least a second pocket on the second longitudinal side of the base rail frame having a second upward angled rail face directed toward the interior portion, wherein the second pocket is formed across the interior portion from the first pocket;

providing a first compressor beam having a first end and a second end, a top surface, a first longitudinal side, and a second longitudinal side;

forming a first downward angled face on the first end of the first compressor beam that is configured to substantially mate with the first upward angled rail face of the first pocket;

forming a second downward angled face on the second end of the first compressor beam that is configured to substantially mate with the second upward angled rail face of the second pocket; and disposing the first compressor beam on to the base rail frame such that the first pocket engages the first downward angled face of the first end of the first compressor beam and such that the second pocket engages the second downward angled face of the second end of the first compressor beam.

21. The method of manufacturing a support unit for supporting a portion of a heating, ventilation, and cooling system of claim 20, further comprising:

disposing a base pan onto the base rail frame covering the interior portion and wherein the base rail frame is substantially flush with the top of the first compressor beam; and fastening the base pan to the first compressor beam with a plurality of fasteners.

* * * * *